United States Patent [19]

Stamm et al.

[11] Patent Number: 4,712,289

[45] Date of Patent: Dec. 15, 1987

[54] INSTALLATION FOR THE AUTOMATIC GRINDING OF CURVED SURFACES

[75] Inventors: Wolfgang Stamm, Puchheim; Dieter König, Munich, both of Fed. Rep. of Germany

[73] Assignee: Bayerische Motoren Werke Aktiengesellschaft, Munich, Fed. Rep. of Germany

[21] Appl. No.: 762,676

[22] Filed: Aug. 5, 1985

[30] Foreign Application Priority Data

Aug. 22, 1984 [DE] Fed. Rep. of Germany ..... 3430856

[51] Int. Cl.[4] ..... B23Q 3/157

[52] U.S. Cl. ..... 29/568; 51/168; 51/377

[58] Field of Search ..... 29/568, 26 A; 279/2 R; 51/376, 377, 378, 168; 74/473 P, 471; 409/175, 178, 179, 190, 191, 201, 232 C, 234

[56] References Cited

U.S. PATENT DOCUMENTS

| | | | |
|---|---|---|---|
| 3,627,490 | 12/1971 | Asano | 51/168 |
| 4,158,935 | 6/1979 | Robert | 51/170 T |
| 4,486,941 | 12/1984 | Scott et al. | 29/568 |
| 4,551,902 | 11/1985 | Thibaut | 51/168 |

FOREIGN PATENT DOCUMENTS

| | | | |
|---|---|---|---|
| 703463 | 3/1941 | Fed. Rep. of Germany | 51/197 |
| 911081 | 6/1946 | France | 51/379 |
| 39296 | 3/1979 | Japan | 29/568 |

*Primary Examiner*—Z. R. Bilinsky
*Attorney, Agent, or Firm*—Barnes & Thornburg

[57] ABSTRACT

An installation for the automatic grinding of surfaces, especially of body surfaces to be painted of a motor vehicle, in which the grinding aggregate is machine-guided and the grinding disk exchange at the grinding aggregate is realized automatically. For that purpose, the installation provides a grinding disk magazine, a container filled with liquid as well as a support plate. Additionally, the grinding aggregate includes within the area of its grinding wheel a clamping mechanism for the grinding disk which is actuatable hydraulically or pneumatically.

32 Claims, 7 Drawing Figures

INSTALLATION FOR THE AUTOMATIC GRINDING OF CURVED SURFACES

The present invention relates to an installation for automatically grinding surfaces, especially curved or arcuate surfaces, of the body of a motor vehicle to be painted.

During the painting of automobile bodies, after priming, at first a filler is applied on the body sheet metal part, which serves as base for the cover paint. Prior to the application of the cover paint, this filler has to be smoothed out by grinding.

A semi-automatic grinding apparatus for body roofs is disclosed in the journal, "Industrie-Lackier-Betrieb," [Industry-Paint-Operation], 32nd Year No. 8, 1964, pages 278 to 280. In this article, the grinding aggregate is machine-guided. The grinding aggregate itself includes three jointedly arranged grinding wheels, on which one grinding paper or grinding disk each is glued on. The exchange of a used-up grinding disk for a new one must necessarily be undertaken by hand by reason of the glued connection. This exchange is time-consuming and has a disadvantageous effect for the station time periods of a series manufacture.

It is the object of the present invention to further automate an installation of the aforementioned type, in particular, also the exchange of the grinding disk is to be taken over by the installation.

The underlying problems are solved according to the present invention in that the installation includes a grinding disk magazine and a mechanism for the automatic exchange of a used-up grinding disk for a new, unused grinding disk on the grinding wheel, and in that the grinding disk is secured at the grinding wheel by means of a clamping mechanism rotatably retained about the axis of the grinding wheel and enabling an automatic exchange of the grinding disk.

Accordingly, the installation of the present invention includes a grinding disk magazine which holds non-used grinding disks in readiness for the exchange. Furthermore, a mechanism is provided with the tasks to take off the used-up grinding disk from the grinding wheel and to enable the automatic fastening of the new grinding disk. Finally, the grinding aggregate includes a clamping mechanism, by the actuation of which the grinding disk can be released or fastened. The clamping mechanism itself can be rotated about the axis of the grinding wheel relative to the latter.

The use of a clamping mechanism overcomes the difficulties which result with the exchange of a glued-on grinding disk according to the state of the art. By the use of the clamping mechanism, the grinding disk is no longer fixedly connected with the support surface of the grinding wheel, it is now held only by the clamping mechanism. By releasing the clamping mechanism, it can therefore be removed from the grinding wheel without difficulty.

By reason of the fact that the grinding disk abuts only loosely at the support surface of the grinding wheel, relative movements occur between the grinding wheel and the grinding disk during the grinding operation. If the clamping mechanism were fixedly connected with the grinding wheel, these relative movements would lead to warpings and deformations of the grinding disk and therewith to grooves or furrows in the ground surface. Such grooves or furrows are not desirable because they can be seen through the cover paint.

In order to avoid this, the clamping mechanism is held rotatable with respect to the grinding wheel according to the teachings of the present invention. At the outset, no genuine drive connection between grinding disk and driving wheel results thereby. However, during the grinding, the grinding disk is pressed against the grinding wheel and the force-locking connection resulting from the friction takes along the grinding disk. This effect, however, will occur only if the friction forces between grinding surface and grinding disk are smaller than those between grinding disk and grinding wheel. This can be achieved without difficulty by the selection of a suitable grinding disk and of the material of the grinding wheel. For grinding automobile bodies, grinding disks with lattice structure and open meshes or interstices are used whereas the grinding wheel consists of a soft, elastic material. In this manner, the lattice threads of the grinding wheel can be pressed into the grinding wheel during the grinding operation and can find the anchoring necessary for the frictional connection.

The grinding disk, however, is already taken along when the grinding wheel rotates but has not been placed as yet on the surface to be ground. This is conditioned by the breakaway forces of the rotatably supported clamping mechanism as well as the mass moment of inertia thereof, to which is added the mass moment of inertia of the grinding disk.

Curved or arcuately shaped surfaces can be ground fully automatically with the installation of the present invention. As in the prior art, the grinding aggregate is also machine-guided. Therebeyond, no manual interaction needs to be made for the exchange of the grinding disks. The cost-favorable use of such an installation exists where a large number of similar arcuately shaped surfaces must be ground as is the case, for example, in the automobile manufacture. The installation can be inserted without any difficulties in the manufacturing process.

Ground surfaces of always constant quality can also be achieved with the installation of the present invention. This is conditioned, on the one hand, by the machine-guided grinding aggregate which, during each grinding operation, travels through the same grinding paths with constant abutment pressure. On the other hand, the grinding disk exchange takes place always after a predetermined number of ground surfaces. The point in time of the grinding disk exchange therefore is not subjected to the more or less correct estimate of a worker. The installation is appropriately electronically controlled by known means.

Advantageous constructions of the installation of the present invention can be realized by the use of several features. Thus, for example, the grinding disk magazine is constructed as hollow cylinder open at the top which receives the grinding disks stacked one above the other which, as a rule, are round. The grinding disks are taken off from the top successively. The inner diameter of the hollow cylinder corresponds approximately to the diameter of the grinding disks. As a result of this measure, they are already in the correct position for the removal. In the automobile manufacture, grinding disks are used, as a rule, which have a lattice structure with open interstices and in which a grinding granulation is applied on both sides. Such grinding disks are relatively stiff in the dry condition and therefore have to be "soaked" prior to grinding use. The hollow cylinder is therefore filled with water. For certain reasons which will be explained more fully hereinafter, the water, however, must not reach up to the upper grinding disks.

According to an advantageous construction of the installation for the exchange of the grinding disk, a support table with central aperture is provided for the fastening of the grinding disk, onto which the grinding aggregate presses the grinding disk, as will also be explained more fully hereinafter, and thus holds the same fast for the clamping operation. For releasing the grinding disk, a tank is provided filled with a liquid, as a rule with water. The grinding wheel immerses into this tank together with the grinding disk adhering at the grinding wheel and with a released clamping mechanism. The surface tension of the liquid holds back the grinding disk in the liquid during the retraction of the grinding wheel, whereupon the grinding disk then slowly sinks toward the tank bottom.

In a particularly advantageous construction, the installation automatically turns a grinding disk which can be used on both sides. For that purpose, a sieve plate is provided which is adapted to be immersed into the tank by means of a pivot arm. The sinking grinding disk is caught by the sieve plate and is pulled out of the tank by pivoting the sieve plate. If it involves a grinding disk usable on both sides, then by further pivoting the sieve plate, the grinding disk can be returned into the grinding disk magazine, rotated through 180° where it is ready for a new grinding use. If it involves a grinding disk utilizable on one side only or if both sides of the grinding disk have already been worn off, it is deposited into a corresponding trash container by pivoting the sieve plate.

The edge of the sieve plate immersed in the liquid container appropriately tapers conically in the downward direction to the diameter of the grinding disk. As a result thereof, the sinking grinding disk is centered in the sieve plate in a position which permits without difficulty the subsequent return into the grinding disk magazine.

A particularly advantageous clamping mechanism and grinding aggregate appropriate therefor involve a clamping mechanism that consists essentially of a clamping cone and of a counter-abutment, between which grinding lugs of the grinding disk are clamped-in. The clamping cone can be actuated hydraulically. The grinding water serves as hydraulic medium, which otherwise is discharged toward the outside by way of a through-flow channel in the clamping cone. In the actuating case, this through-flow channel is closed off by way of a valve cap by reinforcing the grinding water inflow. If the grinding water is not to be fed by way of the clamping cone, the latter can also be actuated pneumatically.

The clamping cone and the counterabutment can be rotated relative to the grinding wheel. In an advantageous realization, they are so constructed that they can also carry out an axial movement in the direction of the grinding disk axis. As a result of this measure, folds of the fastening lugs of the grinding disk causing grinding grooves or furrows are avoided in the clamping area, which might occur if the grinding disk is slightly compressed during the grinding operation.

The drive connection between grinding spindle and grinding wheel is taken over according to the present invention by a connecting cable which is guided through the grinding spindle and is secured with its ends diametrally opposite at the grinding wheel. Appropriately, pivotally supported clamping jaws are provided for that purpose. As a result thereof, the connecting cable is not stressed excessively in bending at the fastening places by the constant changes in inclination of the grinding wheel. An optimum true rotation of the grinding wheel is also achieved by this drive connection when the grinding wheel is inclined with respect to the grinding spindle. For grinding arcuately shaped surfaces, such an inclination ability of the grinding spindle is a prerequisite. Otherwise, the grinding aggregate would have to have a curved track guidance. The inclination itself takes place by way of the universal joint provided above the grinding wheel.

As already mentioned, the grinding wheel is connected with the grinding spindle by way of a universal joint. The universal joint is thereby advantageously arranged directly above the grinding wheel so that only a small distance can form between the grinding wheel and the working surface. In this manner, it is possible to prevent a buckling away or bending away of the grinding wheel when placing the grinding aggregate on the surface to be ground.

These and other objects, features and advantages of the present invention will become more apparent from the following description when taken in connection with the accompanying drawing which shows, for purposes of illustration only, one embodiment in accordance with the present invention, and wherein.

Figure 1:
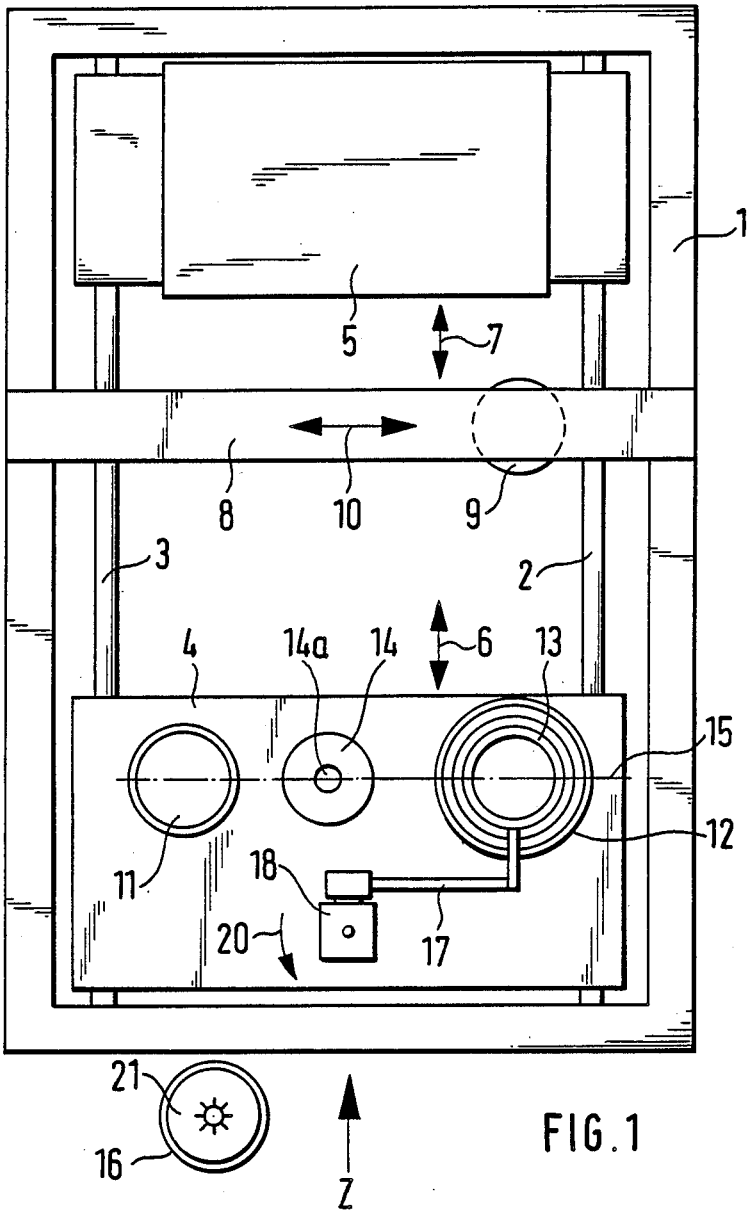
FIG. 1 is a plan view on a schematically illustrated installation according to the present invention.

Referring now to the drawing wherein like reference numerals are used throughout the various views to designate like parts, and more particularly to FIG. 1, an installation for the automatic grinding of arcuately shaped surfaces is schematically illustrated in this figure. A rectangular frame 1 can be recognized in this figure with guidance 2 and 3, on which the tables 4 and 5 are displaceable in the longitudinal direction. The displaceability of the tables 4 and 5 is indicated by the double arrows 6 and 7. Additionally, a transverse bearer 8 is secured at the frame 1. The transverse bearer 8 receives a grinding aggregate 9 suspended thereon and enables a displaceability in the direction of the double arrow 10 to the grinding aggregate 9.

The table 5 serves for the support of the sliding roof of a vehicle body. The table 4 carries an installation for the automatic exchange of a used-up grinding disk for a non-used, new one at the grinding aggregate 9, respectively, for turning a grinding disk used on one side. For that purpose, a grinding disk magazine 11, a tank 12 filled with a liquid, a sieve plate 13 immersed therein as well as a support plate 14 are arranged on the table 4 whereby support plate 14 has a central through-bore 14a. The grinding disk magazine 11, the tank 12 and the support plate 14 are in a common plane as is indicated by the line 15.

Figure 2:
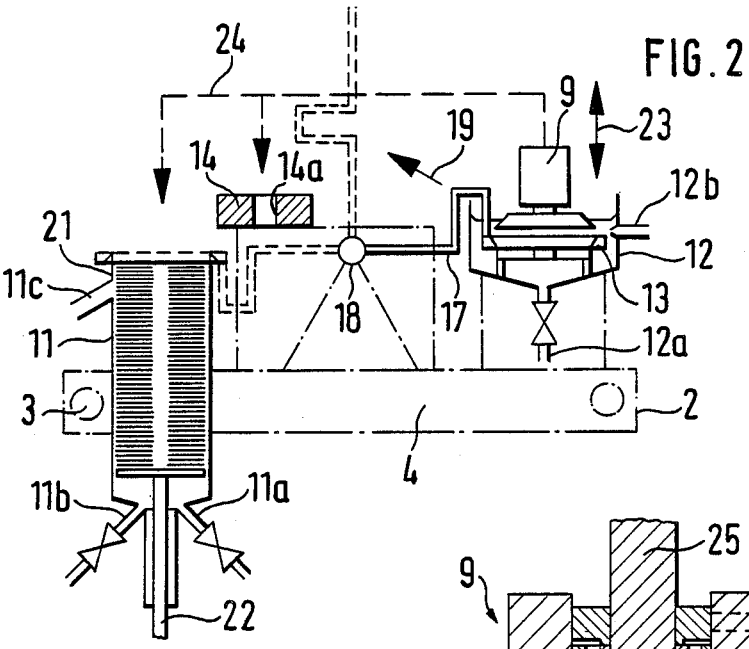
FIG. 2 is a front elevational view of the installation according to the direction of arrow Z of FIG. 1.

A pivot arm 17 connects the sieve plate 13 with a double pivot joint 18 which permits, on the one hand, a rotary movement about an axis extending parallel to the guidances 2 and 3. This is indicated in FIG. 2 by an arrow 19. Furthermore, the pivot joint 18 permits a rotation about the vertical axis extending in the plane of the drawing. The arrow 20 (FIG. 1) indicates this rotary movement.

Finally, FIG. 1 illustrates a trash container 16 for the deposit of used-up grinding disks.

FIG. 2 illustrates the installation according to FIG. 1 taken in the direction of arrow Z. In FIG. 2, the installation is again illustrated only schematically. Additionally, the grinding aggregate 9 immerses into the container 12. The table 4 is therefore under the transverse cross bearer 8.

According to FIG. 2, the grinding disk magazine 11 consists of a hollow cylinder in which round grinding disks are stacked one above the other. The hollow cylinder includes feed lines 11*a* and 11*b* and a discharge 11*c*. By way of these lines, the hollow cylinder is supplied with water. A push rod 22 extends from below through this hollow cylinder. At its end projecting into the hollow cylinder, a plate is secured on the push rod 22, on which lies the stack of grinding disks. With the aid of an adjusting member, for example, a hydraulic cylinder, the stack can be readjusted in a conventional manner by way of the push rod 22, each time a grinding disk is removed.

The container 12 is also provided with similar discharge and feed lines 12*a* and 12*b*. Similarly, this container or tank 12 is filled with water. FIG. 2 additionally indicates by means of a double arrow 23 and a movement track 24, shown in dash line, that the grinding aggregate 9, guided at the transverse bearer 8, can move upwardly out of the container 12, can travel sideways laterally and can be lowered into the grinding disk magazine 11 and onto the support plate 14. Furthermore, FIG. 2 indicates in dash lines individual positions of the pivot arm 17 with the sieve plate 13. It can also be recognized from FIG. 2 that the edge of the sieve plate 13 immersed in the tank 12 tapers in the downward direction.

Additionally, the mounting of the support plate 14 on the table 4 is indicated in FIG. 2 in dash lines. The same is true for the pivot joint 18.

Figure 3:
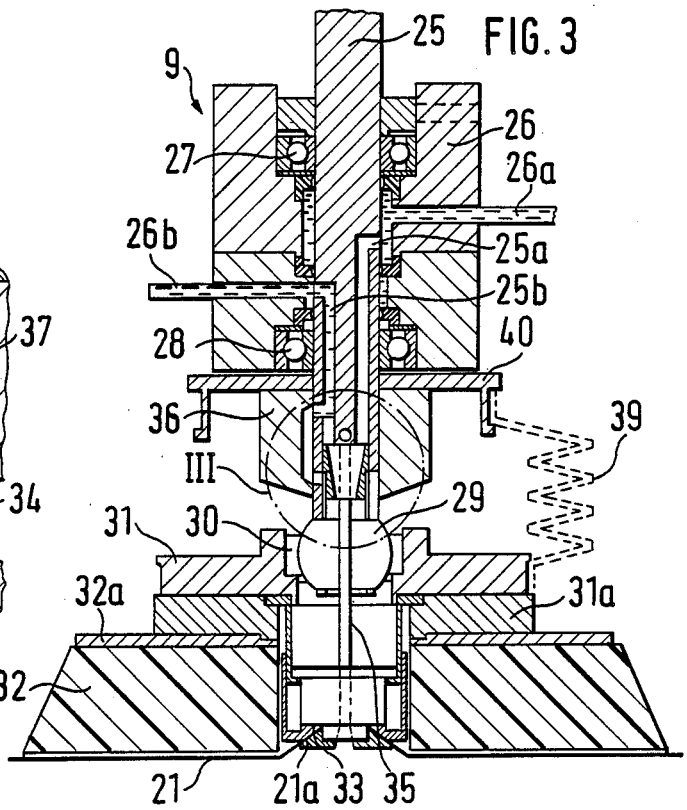
FIG. 3 is a cross-sectional view through the lower part of a grinding aggregate in accordance with the present invention.

The lower section of the grinding aggregate 9 can be seen from FIG. 3. For the sake of completeness, it should be mentioned that the upper section (not shown) of the driving aggregate 9 includes the driving motor; the driving motor is therefore an integrated component of the driving aggregate. The driving aggregate is composed in the section illustrated in FIG. 3 of a grinding spindle 25 which is rotatably supported in a bearing block 26 by way of roller bearings 27 and 28. A ball-shaped inner bearing race 29 of a universal joint is secured at the lower section of the grinding spindle 5. The corresponding outer bearing race 30 is disposed in a grinding wheel carrier 31; the grinding wheel 32, in turn, is secured at the grinding wheel carrier 31 by way of a spacer disk 31*a*. The grinding wheel 32 is retained at the spacer disk 31*a* by way of a conventional bayonet connection.

The grinding wheel 32 itself consists of a soft elastic foamed material whose top side is covered by a stiff fastening plate 32*a* correspondingly shaped for the bayonet locking arrangement. A clamping mechanism 33 not illustrated in detail in FIG. 3 retains a grinding disk 21 at the bottom side of the grinding wheel 32. The grinding disk 21 includes in its center area fastening lugs 21*a* formed by star-shaped slots, which are retained by the clamping mechanism 33. Furthermore, the grinding disk 21 consists of a lattice-like structure with open mesh or interstices. A grinding granulation is applied on both sides of the grinding disk 21 so that the grinding disk can be used on both sides.

Figure 4:
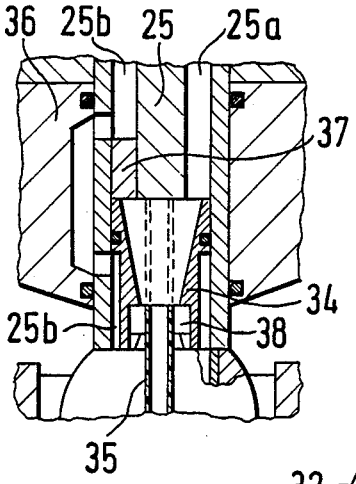
FIG. 4 is a partial cross-sectional view, on an enlarged scale, illustrating the detail in the dash circle of FIG. 3.

The grinding spindle 25 includes two channels extending approximately in the axial direction, namely a grinding water feed channel 25*a* and an air feed channel 25*b*. These channels 25*a* and 25*b* are fed by way of feed means 26*a* and 26*b* in the bearing block 26. FIG. 4 illustrates on an enlarged scale the course of the channel in the lower section of the grinding spindle. As can be seen from this figure, the feed channel 25*a* terminates in a funnel-shaped space which is formed in a sleeve 34 inserted from below into the grinding spindle 25 and offset in the outer diameter. A plastic hose 35, which is displaceably retained inside of the sleeve 34 and whose displaceability is indicated by the dash-line illustration in the funnel-shaped hollow space, leads from the hollow space downwardly to the clamping mechanism 33. The feed channel 25 serves for the supply of the grinding disk with grinding water and for the hydraulic actuation of the clamping mechanism 33, as will be described more fully hereinafter.

According to FIG. 4, the air guide channel 25*b* branches off toward the outside above the sleeve 34, extends from there is a structural part 36 securely connected with the grinding spindle 25 and leads back again into the grinding spindle 25 in the offset area of the sleeve 34 and exits at its lower end, i.e., underneath the inner bearing race 29. The task of the air guide channel 25*b* will be explained in detail by reference to FIG. 5. Additionally, a plug 37, an O-ring about the sleeve 34 as well as a U-ring seal 38 underneath the funnel-shaped opening of the sleeve 34 can be seen in FIG. 4. These components assure that the air guide channel 25*b* is separated from the grinding water-feed channel 25*a*.

A folded bellows 39 can additionally be seen in FIG. 3 which is connected, on the one hand, with the grinding wheel carrier 31 and, on the other, with a structural part 40 secured at the grinding spindle 25. The purpose of this bellows 39 consists in protecting the universal joint and the drive arrangement to be described more fully hereinafter against soiling. Additionally, by reason of its inherent elasticity, it is to effect a return of the grinding wheel 32 into a horizontal position.

Figure 5:
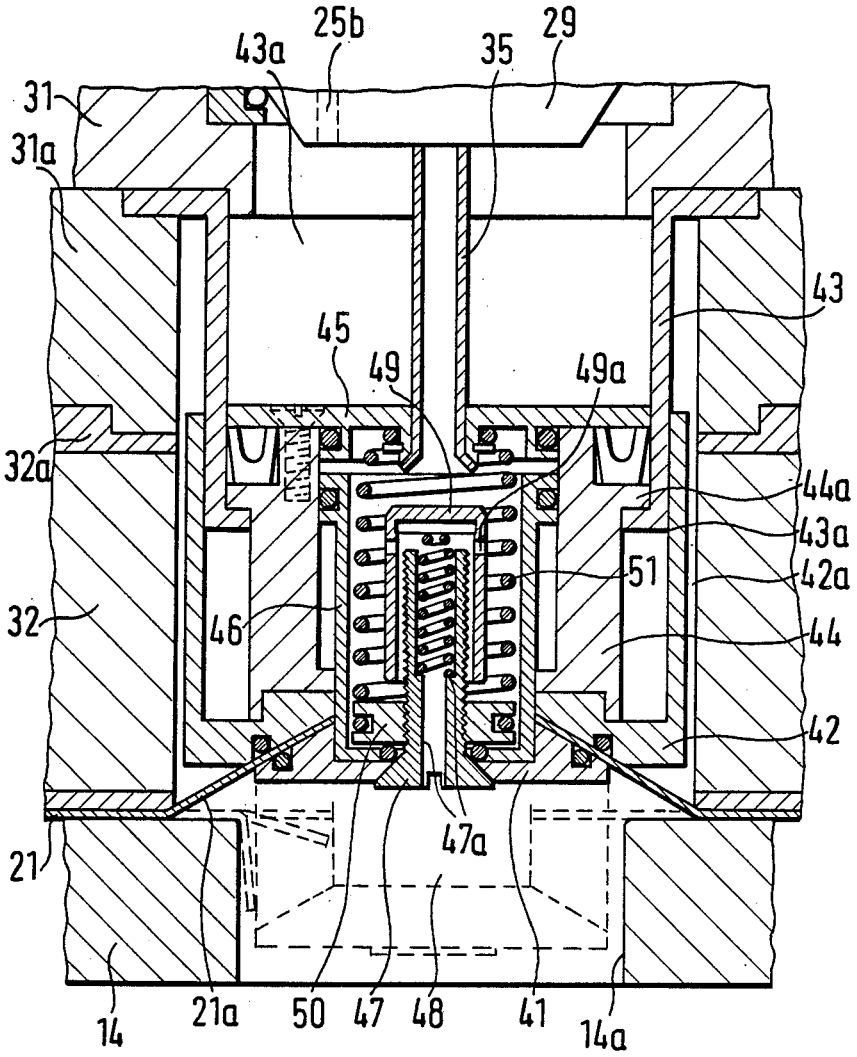
FIG. 5 is a cross-sectional view, on a still further enlarged scale, of a clamping mechanism of the grinding aggregate according to FIG. 3.

The details of the clamping mechanism 33 can be seen in FIG. 5. At the outset, a clamping cone 41 and a counterabutment 42 can be seen in this figure. The counterabutment 42 is extended upwardly into a cylindrical section 42*a* which receives a guide sleeve 43 secured to the grinding wheel carrier 31. Furthermore, a hollow cylinder 44 is secured at the counterabutment 42 which with an upper section thereof is axially displaceably and rotatably guided in the guide sleeve 43 providing also an air-tight seal. A carrier plate 45 which closes off the upper section of this hollow cylinder 44, is secured at the hollow cylinder 44. Additionally, a U-ring seal, not designated by a reference numeral, is provided between the carrier plate 45 and guide sleeve 43. The carrier plate 45 finally receives the lower end of the plastic hose 35. The outer diameter of the carrier plate is so dimensioned that it abuts slidingly at the inner wall of the guide sleeve 43. The guide sleeve 43 forms at its lower section an inner flange 43*a* which also slidingly abuts at the hollow cylinder 44, and a ring flange 44*a* is provided correspondingly at the hollow cylinder 44 which, in turn, slidingly abuts again at the inner wall of the guide sleeve 43. Owing to this construction, the counterabutment 42 can be rotated with respect to the guide sleeve 43 and can be displaced in the axial direction, whereby the axial displaceability is limited in the downward direction by the ring collar 44*a* and the inner shoulder 43*a*.

The clamping cone 41 carries at its side facing the counterabutment 42 a further guide sleeve 46 which is guided in a water-tight manner within the hollow cylinder 44. Additionally, a screw 47 with an offset through-bore 47*a* extends through the clamping cone 41. This through-bore 47*a* serves as through-flow channel for the grinding water. In the upper section opposite the clamping cone 41, a compression spring 48 is arranged in the through-bore 47*a* which acts on a valve cap 49 mounted over the shank of the screw 47. It thereby keeps the inner cap bottom provided with a rubber seal spaced somewhat from the shank end of the screw 47 so that a through-flow is provided by way of the wall bores 49*a* of the valve cap 49 to the through-bore 47*a* of the screw 47.

A nut 50 screwed over the screw 47 clamps together the clamping cone 41 and the guide sleeve 46 by means of the screw 47. The connection is sealed off underneath the nut 50 by an O-ring. The nut 50 serves simultaneously also as anchoring of a draw spring 51 whose other end is suspended in the carrier plate 45.

A clamping operation, i.e., the fastening of a grinding disk at the grinding wheel will now be described hereinafter. At first, it should be pointed out once more that during the grinding operation, grinding water is conducted in small quantities (about 1.5 l/a) to the surface to be ground by way of the feed channel 25*a* (FIG. 3), plastic hose 35, wall bores 49*a* and through-bores 47*a*.

During a clamping operation, the grinding aggregate 9, as will be described more fully hereinafter, will fetch a grinding disk 21 from the grinding disk magazine 11. The grinding disk 21 thereby adheres to the underside of the wet grinding wheel 32 owing to a water film, respectively, by the adhesion which results therefrom. The grinding aggregate 9 is now lowered onto the support plate 14*a* until it rests thereon flush. The fastening lugs 21*a* of the grinding disk 21 project horizontally. The through-flow quantity of the grinding water is now increased suddenly and a dam-up forms in the guide sleeve 46 with the consequence that the valve cap 49 is now pressed on the screw 47 against the force of the compression spring 48. The screw shank closes thereby the through-bores 49*a* so that the grinding water can no longer leave in the downward direction. The pressure which prevails in the guide sleeve 46, is amplified by grinding water which continues to be fed or supplied, and the guide sleeve 46 moves together with the clamping cone 41 downwardly against the force of the spring 51. The clamping cone 41 thereby pierces the fastening lugs 21*a* which thereafter spring back again into the horizontal plane by reason of their elasticity. The pressure of the grinding water is now reduced by a corresponding valve in the feed line 26*a* (not shown in FIG. 3) with the consequence that the draw spring 51 again retracts the clamping cone 41. It thereby takes along the fastening lugs 21*a* in the upward direction by reason of its conical construction and presses the same against the counterabutment 42.

The force of the draw spring 51 is sufficient to adequately clamp fast the fastening lugs 21*a*. Rubber-O-rings, as indicated in FIG. 5, can further assist this clamping action, which are mounted in the outer surfaces of the clamping cone and of the counterabutment. As a result thereof, the friction between the grinding disk lugs and the clamping mechanism is increased. Since the clamping cone and the counterabutment are retained rotatable with respect to the guide sleeve 43, also the grinding disk 21 can thus be rotated with respect to the grinding wheel 32.

As already mentioned, the grinding wheel 32 consists of a soft foamed material. If the grinding aggregate is now placed on the surface to be ground, the grinding wheel 32 is compressed corresponding to the load. If the clamping mechanism were held axially nondisplaceable in the guide sleeve 43, the grinding disk would form folds within the area of the fastening lugs 21*a* during the compressing of the grinding wheel 32, which could lead to grooves or furrows in the grinding surface. In order to preclude this danger, the clamping mechanism is axially displaceable with respect to the guide sleeve 43 in the manner already described. The actual displacement is controlled by way of the air guide channel 25*b* in that a vacuum is being built up by way of the air guide channel 25*b* within the chamber 43*a* of the guide sleeve 43 at least during the grinding operation which pulls the clamping mechanism in the upward direction during the grinding operation against the tensional force of the fastening lugs 21*a* which are clamped-in. In this case, also the plastic hose 35 moves in the upward direction and protrudes into the funnel-shaped aperture of the sleeve 34 (FIG. 4). Since during the grinding of the arcuate surface the grinding wheel must carry out a tumbling movement with respect to the grinding spindle, also the end of the plastic hose 35 can partake in this movement in the funnel-shaped opening.

By lifting the clamping mechanism, it is also prevented that the clamping cone 41 comes into contact with the surface to be ground during the grinding operation. Scratches in the grinding surface might be caused thereby notwithstanding a felt layer bonded or glued to the lower side of the clamping cone 41.

The air guide channel 25*b* has a further task. In case of a grinding wheel exchange, an excess pressure is being built up during a short period of time within the chamber 43*a* (FIG. 5) by way of this channel which forces the clamping mechanism to travel downwardly up to the abutment (inner flange 43*a*). The clamping mechanism must assume this position during the grinding disk exchange because otherwise it would not be assured that in the clamping operation the clamping cone 41 could seize during the retraction the fastening lugs 21*a*.

Figure 6:
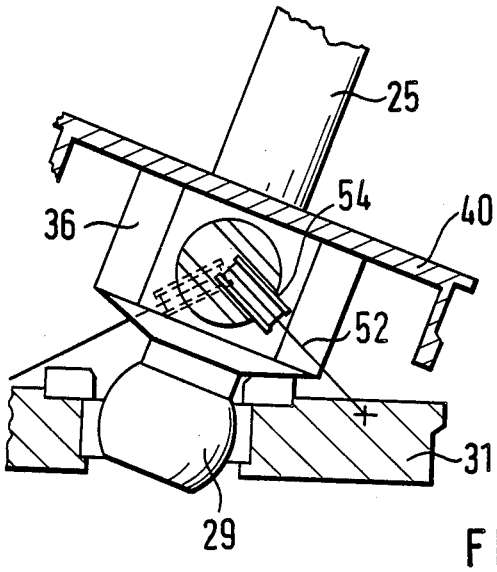
FIG. 6 is a partial view, partly in cross section, illustrating the drive connection between the grinding spindle and the grinding wheel.
Figure 7:
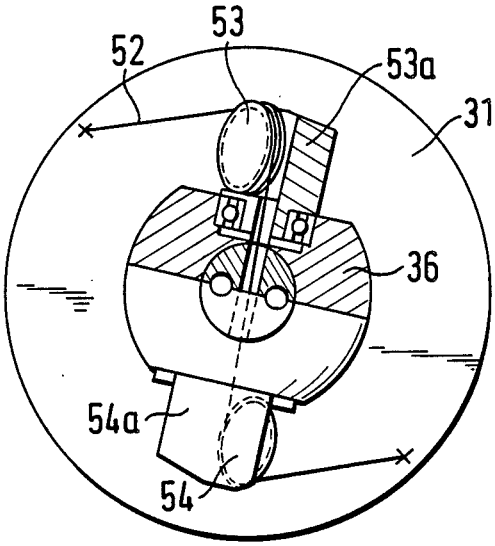
FIG. 7 is a plan view on FIG. 6, partly in cross section.

The drive connection between the grinding wheel and the grinding spindle is illustrated in FIGS. 6 and 7. A connecting cable 52 can be seen in these figures which runs through a cross bore of the grinding spindle 25 and is deflected in opposite direction by way of guide rollers 53 and 54. The connecting cable 52 is secured with its end diametrally opposite at the grinding wheel carrier 31. The guide rollers 53 and 54 rotate in bearing housings 53*a* and 53*b* which, in turn, are again rotatably supported in the structural part 36. One obtains an optimum true rotation of the grinding wheel 32 by means of this drive connection even when the grinding spindle 25 is inclined with respect to the grinding wheel 32. A completely satisfactory true rotation is effective advantageously on the grinding quality.

The entire grinding operation with a grinding disk exchange will be described hereinafter by reference to a sliding roof. Contrary to FIG. 1, in the start position, the carriage or table 4 should be underneath the transverse bearer 8 and the grinding aggregate 9 with its grinding wheel 32 should be immersed in the container 12 filled with water. The sieve plate 13 is also underneath the grinding wheel within the tank 12. An unground sliding roof is secured on the carriage or table 5.

After the initiation of the start, the grinding aggregate 9 emerges from the container 12 and its grinding wheel begins to rotate. As a result thereof, the grinding disk will abut planar at the bottom side of the grinding wheel where it remains connected also without rotation by reason of the adhesion effect which is caused by the water film present thereat.

The carriage 4 travels into the position illustrated in FIG. 1 and the carriage 5 now moves together with the sliding roof underneath the transverse bearer 8. The grinding aggregate 9 is lowered with its rotating grinding wheel onto the sliding roof. Additionally, grinding water starts to flow out of the clamping cone. The grinding operation, properly speaking, now begins. The grinding aggregate thereby moves along the transverse bearer 8 toward the left (FIG. 1) and back. At the same time, the table or carriage 5 oscillates perpendicularly thereto. In this manner, the sliding roof is ground in several tracks.

After completion of the grinding operation, the grinding aggregate 9 is now lifted and the carriage 5 travels back into its starting position. The grinding aggregate now has the position illustrated in FIG. 1.

It is now assumed that the grinding disk side is already used up after this grinding operation. In reality, up to six sliding roofs can be ground with the same grinding disk side; however, the grinding disk has to be washed out after each sliding roof, which can be realized by spraying with water nozzles which are secured, for example, at the grinding aggregate.

The carriage 4 now travels underneath the transverse bearer 8 and the grinding aggregate 9 is lowered into the container 12 filled with liquid (FIG. 2). Simultaneously with the lowering, the clamping cone is released in the manner described above. By reason of the physical laws, the adhesion effect between the grinding disk provided with open interstices and the bottom side of the immersed grinding disk now disappears. If the grinding aggregate 9 is again lifted out of the container 12, the grinding disk is pulled off from the clamping cone 41 by reason of the surface tension of the liquid and remains within the tank. It sinks slowly and is then caught by the sieve plate 13.

The grinding aggregate 9 now travels along the movement path 24 to the grinding disk magazine 11 and is lowered over the uppermost grinding disk. The grinding wheel is thereby still wet. It is assured by the water circulation in the grinding disk magazine that the grinding disks are all "soaked"; however, at least the upper two grinding disks are merely moistened. Moistened in this sense means that the open interstices of the lattice structure are not filled out with water. This is achieved by briefly blowing-out the uppermost grinding disks by means of a compressed air nozzle (not shown in the drawing), respectively, by the water discharge 11c underneath the upper grinding disks. Owing to the wet grinding wheel, the moistened uppermost grinding disk will adhere at the grinding wheel by reason of the adhesion force. The grinding aggregate 9 subsequently again is lifted upwardly and travels at the same time toward the support plate 14 and is lowered onto the same until the grinding wheel rests flush thereat. The clamping-fast of the grinding disk now takes place in the manner already described hereinabove.

After the fastening, the grinding aggregate 9 is lifted again and travels along the cross bearer 8 into its starting position in order to be readied for a renewed grinding operation. In the meantime, the carriage 5 has also been provided with a new sliding roof.

During this new grinding operation, the arm 17 pivots the sieve plates 13 out of the container 12. The deposited first grinding disk now rests on the sieve plate 13 with the used side facing downwardly. By reason of the occuring adhesion which is effected by the water and the lattice structure of the grinding disk and of the sieve plate, the grinding disk adheres at the sieve plate. The pivot arm 17 pivots through 180° toward the grinding disk magazine 11. By a somewhat stronger impingement on the grinding disk magazine, the grinding disk falls into the same. It now lies with its nonused side facing downwardly. It thus has been turned through 180° and lies ready for a renewed grinding use. The pivot arm 17 pivots back into the container 12.

The push rod 22 (FIG. 2) of the grinding disk magazine which belongs to a pneumatic cylinder assures that the grinding disk stack is always lifted up to the working height of the grinding wheel.

If the grinding disk has been used already on both then the pivot arm 17 at first pivots only through 90° in the upward direction, then rotates in the direction of the arrow 20 (FIG. 1) and finally pivots through a further 90° over the trash container 16 where it deposits the grinding disk.

The control of this installation is not illustrated in the drawing but is realizable without difficulty by conventional, known means so that a further explanation thereof is dispensed with herein.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An installation for the automatic grinding of surfaces, especially of body surfaces to be painted, comprising a grinding aggregate including a rotating grinding wheel operatively connected with a grinding spindle means by way of a universal joint and a grinding disk interchangeably secured at the rotating grinding wheel, the grinding aggregate being machine-guided during its operation, a grinding disk magazine means, means for automatically exchanging at the grinding wheel a used-up grinding disk for a new grinding disk, and clamping means for securing the rotating grinding disk at the grinding wheel, said clamping means being relatively rotatable with respect to the grinding wheel and enabling an automatic exchange of the grinding disk.

2. An installation according to claim 1, wherein the grinding disk magazine means includes a hollow cylinder means containing a liquid and being open at the top, which receives the substantially round grinding disks stacked one above the other.

3. An installation according to claim 2, wherein the height position of the grinding disk package inside of the hollow cylinder means is adjustable by way of a lifting means.

4. An installation according to claim 3, wherein the means for exchanging the grinding disks includes a support plate means and a container means filled with a liquid.

5. An installation according to claim 4, further comprising a sieve plate secured at a pivot arm means, said sieve plate being adapted to be immersed into the container means by movement of said point arm 6. An installation according to claim 5, wherein the edge of the sieve plate means immersed in the container means tapers conically in the direction toward the diameter of the grinding disk.

7. An installation according to claim 1, in which the grinding disk used in the installation has in its center area fastening lugs formed by star-shaped slots, by means of which the grinding disk is held at the grinding wheel by the clamping means, the clamping means including an actuatable clamping cone means and a counterabutment means constructed as an internal cone, the clamping cone being actuatable in the axial direction hydraulically or pneumatically.

8. An installation according to claim 7, wherein the clamping means is axially displaceable.

9. An installation according to claim 8, wherein a guide sleeve is secured at the grinding wheel which holds the counterabutment means rotatable, and the clamping cone means being axially displaceably guided with respect to the counterabutment means within one of counterabutment means and a structural part securely connected therewith.

10. An installation according to claim 9, wherein the counterabutment means is axially displaceably held by the guide sleeve.

11. An installation according to claim 10, wherein the grinding spindle means includes an air guide channel terminating in the guide sleeve.

12. An installation according to claim 11, wherein a through-flow channel for grinding liquid is provided in the clamping cone means, the through-flow channel being fed by a feed channel provided in the grinding spindle means.

13. An installation according to claim 12, wherein the through-flow channel is adapted to be closed off by means of a spring-loaded valve cap.

14. An installation according to claim 12, further comprising a flexible hose establishing the connection between the feed channel of the grinding spindle means and the through-flow channel of the clamping cone means.

15. An installation according to claim 12, further comprising drive connection means between the grinding spindle means and the grinding wheel including a connecting cable guided through the grinding spindle means, which connecting cabs has ends secured diametrally opposite at the grinding wheel by way of pivotally supported clamping jaws.

16. An installation according to claim 15, wherein the connecting cable extends approximately Z-shaped from one fastening point to the other.

17. An installation according to claim 16, wherein the grinding spindle means includes pivotally supported guide rollers for the connecting cable.

18. An installation according to claim 17, wherein the installation has a rectangular frame with two carriages movable in the longitudinal direction and a cross girder secured at the frame and supporting the grinding aggregate, one of the carriages serving for supporting the workpiece surface to be ground and the other carriage supporting the means serving for the automatic exchange of the grinding disk.

19. An installation according to claim 7, wherein a guide sleeve is secured at the grinding wheel which holds the counterabutment means rotatable, and the clamping cone means being axially displaceably guided with respect to the counterabutment means within one of counterabutment means and a structural part securely connected therewith.

20. An installation according to claim 19, wherein the counterabutment means is axially displaceably held by the guide sleeve.

21. An installation according to claim 19, wherein the grinding spindle means includes an air guide channel terminating in the guide sleeve.

22. An installation according to claim 21, wherein a through-flow channel for grinding liquid is provided in the clamping cone means, the through-flow channel being fed by a feed channel provided in the grinding spindle means.

23. An installation according to claim 22, wherein the through-flow channel is adapted to be closed off by means of a spring-loaded valve cap.

24. An installation according to claim 22, further comprising a flexible hose establishing the connection between the feed channel of the grinding spindle means and the through-hole channel of the clamping cone means.

25. An installation according to claim 1, further comprising drive connection means between the grinding spindle means and the grinding wheel including a connecting cable guided through the grinding spindle means, which with its ends is secured diametrally opposite at the grinding wheel by way of pivotally supported clamping jaws.

26. An installation according to claim 25, wherein the connecting cable extends approximately Z-shaped from one fastening point to the other.

27. An installation according to claim 25, wherein the grinding spindle means includes pivotally supported guide rollers for the connecting cable.

28. An installation according to claim 1, wherein the installation has a rectangular frame with two carriages movable in the longitudinal direction and a cross girder secured at the frame and supporting the grinding aggregate, one of the carriages serving for supporting the workpiece surface to be ground and the other carriage supporting the means serving for the automatic exchange of the grinding disk.

29. An installation according to claim 28, wherein the means for exchanging the grinding disks includes a support plate means and a container means filled with a liquid.

30. An installation according to claim 29, further comprising a sieve plate secured at a pivot arm means, said sieve plate being adapted to be immersed into the container means.

31. An installation according to claim 30, wherein the grinding disk magazine means includes a hollow cylinder means containing a liquid and being open at the top, which receives the substantially round grinding disks stacked one above the other.

32. An installation according to claim 31, wherein the height position of the stacked grinding disks inside of the hollow cylinder means is adjustable by way of a lifting means.

* * * * *